US005283168A

United States Patent [19]

Nelson et al.

[11] Patent Number: 5,283,168

[45] Date of Patent: Feb. 1, 1994

[54] SILVER HALIDE EMULSION SENSITIZED WITH A HEAVY METAL COMPOUND AND A THIOUREA COMPOUND

[75] Inventors: Roger W. Nelson, Fairport; Edward G. Bourne, Penfield, both of N.Y.

[73] Assignee: Eastman Kodak Company, Rochester, N.Y.

[21] Appl. No.: 876,263

[22] Filed: Apr. 30, 1992

[51] Int. Cl.[5] ..... G03C 1/09

[52] U.S. Cl. ..... 430/600; 430/603; 430/605

[58] Field of Search ..... 430/567, 569, 603, 604, 430/605, 600

[56] References Cited

U.S. PATENT DOCUMENTS

| | | | |
|---|---|---|---|
| 2,410,689 | 11/1946 | Sheppard et al. | 430/603 |
| 2,448,060 | 8/1948 | Smith et al. | 430/605 |
| 4,629,678 | 12/1986 | Murai | 430/605 |
| 4,693,965 | 9/1987 | Ihama et al. | 430/569 |
| 4,786,588 | 11/1988 | Ogawa | 430/603 |
| 4,810,626 | 3/1989 | Burgmaier et al. | 430/569 |
| 4,902,611 | 2/1990 | Leubner et al. | 430/569 |
| 4,952,491 | 8/1990 | Nishikawa et al. | 430/567 |
| 4,997,751 | 3/1991 | Kim | 430/569 |

OTHER PUBLICATIONS

Abstract of European Patent 466416, Jul. 9, 1990.

Abstract of Japanese Patent 03-279940, Mar. 28, 1990.

*Primary Examiner*—Janet C. Baxter

*Attorney, Agent, or Firm*—Paul A. Leipold

[57] ABSTRACT

The invention is generally accomplished when a heavy metal compound and a substituted thiourea sensitizer are used together as chemical sensitizers. There is a surprising increase in photographic efficiency and, therefore, in photographic sensitivity. This effect does not depend on the presence of a dye. The preferred heavy metal compound is potassium hexachloroiridate (IV), and the preferred thiourea is 3-acetamidophenyl thiourea.

16 Claims, 1 Drawing Sheet

SILVER HALIDE EMULSION SENSITIZED WITH A HEAVY METAL COMPOUND AND A THIOUREA COMPOUND

TECHNICAL FIELD

This invention relates to a method for manufacturing chemically and spectrally sensitized silver halide emulsions, particularly to a method for manufacturing chemically and spectrally sensitized silver halide emulsions of improved photographic sensitivity and other properties by use of a heavy metal salt in combination with a particular type of sulfur sensitizer during the chemical ripening process.

BACKGROUND ART

Silver halide emulsions are generally prepared in the following steps: precipitation (with or without incorporated dopants), physical ripening (which may occur concurrently with the precipitation), desalting (also known as emulsion washing), and chemical ripening (often referred to as sensitization or emulsion finishing).

Emulsion precipitation is generally carried out in the presence of a peptizing agent, commonly gelatin, to keep the precipitated emulsion grains separated from one another and to avoid clumping or coagulation. The precipitation process consists of the chemical reaction of a soluble silver salt, usually the nitrate salt, with a soluble halide salt or mixture of halide salts to form a precipitate of the desired relatively insoluble silver halide salt or mixed salt.

Byproducts of this chemical reaction usually include soluble alkali nitrates, which are subsequently removed by the washing process, lest they form undesirable crystals when the emulsion is coated or otherwise used to make a photographic element.

Various other chemicals, sometimes even dyes, can be used during the precipitation process to prevent or minimize foaming, act as sensitizers, stabilizers, etc. In addition, certain chemicals may be added with the intention that they be incorporated into the silver halide crystal lattice for the purpose of controlling fog, reciprocity behavior, etc.

The chemical ripening or finishing process often consists of a chemical sensitization part and a spectral sensitization part, and these may be done consecutively or concurrently. Chemical sensitization commonly consists of treatment with sensitizing chemicals such as sulfur and/or gold compounds, followed by a heat treatment.

Spectral sensitization comprises the addition of a spectral sensitizing dye which is capable of being adsorbed to the emulsion grain surface and renders the emulsion sensitive to visible or infrared radiation, whereas the non-spectrally sensitized emulsion is sensitive only in the ultraviolet or blue regions of the electromagnetic spectrum. The spectral sensitizing dye may be present during the heat treatment or it may be added after the heat treatment.

In addition, other chemicals may be used in this process to act as modifiers, restrainers, antifoggants, stabilizers, etc.

It is frequently a goal of photographic research and development efforts to increase the sensitivity of a photographic element without any sacrifice, or even with an improvement, in other performance characteristics such as granularity, sharpness, reciprocity behavior, color reproduction, stability of the latent image, stability to temperature or humidity conditions, insensitivity to pressure effects, etc.

A common means of increasing photographic sensitivity is to use emulsions of larger grain size, but this generally leads to compromises with one or more of the characteristics noted above. Therefore, it is of extraordinary benefit if a means can be discovered of increasing the basic sensitivity of a photographic emulsion without altering its grain size. This essentially means increasing the efficiency of the emulsion in its conversion of the photons which fall upon it into developable latent image.

The use of heavy metal salts to increase emulsion sensitivity goes back at least as far as the work of Smith and Trivelli, U.S. Pat. No. 2,448,060. The desirable capability of some of these heavy metal salts to reduce the extent of reciprocity law failure has also been recognized for a long time.

Heavy metal salts, for example iridium, are most commonly incorporated into a photographic emulsion as a dopant during the silver halide grain forming process—prior to sensitization. A stable solution of $K_2IrCl_6$ in nitric acid was disclosed by Leubner and White in U.S. Pat. No. 4,902,611. They disclosed that such a solution could be used either before or after the precipitation of a photographic emulsion.

More recently, as means other than heavy metal salts of increasing emulsion sensitivity have improved, it is now commonly observed that the use of these heavy metal salts in addition to the other sensitizers actually results in a loss of photographic sensitivity. Furthermore, the use of the heavy metal salts may lead to an undesirable contrast change in the characteristic density-log(exposure) curve of a photographic product.

In U.S. Pat. No. 4,693,965, Ihama and Tani sought to overcome the desensitizing effect of a dye by adding iridium to the chemical ripening along with a carbocyanine spectral sensitizing dye which forms J-aggregates.

In U.S. Pat. No. 4,810,626, Burgmaier et al disclosed the use of tetrasubstituted thiourea-type compounds as silver halide sensitizers. In the descriptions and examples which follow herein, it will be seen that it is not necessary for our purposes that the thiourea compound be tetra (i.e., fully) substituted. The preferred organic sulfur sensitizer of this invention is a mono-substituted thiourea compound.

There is a continuing need for photographic materials that will have improved latent image stability and reciprocity behavior without loss of speed.

THE INVENTION

An object of this invention is to overcome disadvantages of prior processes of emulsion sensitization.

An object of the invention is to improve speed and emulsion efficiency in converting photons to developable latent image.

It has been discovered that when a heavy metal compound and a substituted thiourea sensitizer are used together as chemical sensitizers, there is a surprising increase in photographic efficiency and, therefore, in photographic sensitivity. This effect does not depend on the presence of a dye. The preferred heavy metal compound is potassium hexachloroiridate(IV), and the preferred thiourea is 3-acetamidophenyl thiourea.

MODES FOR CARRYING OUT THE INVENTION

Figure 1:
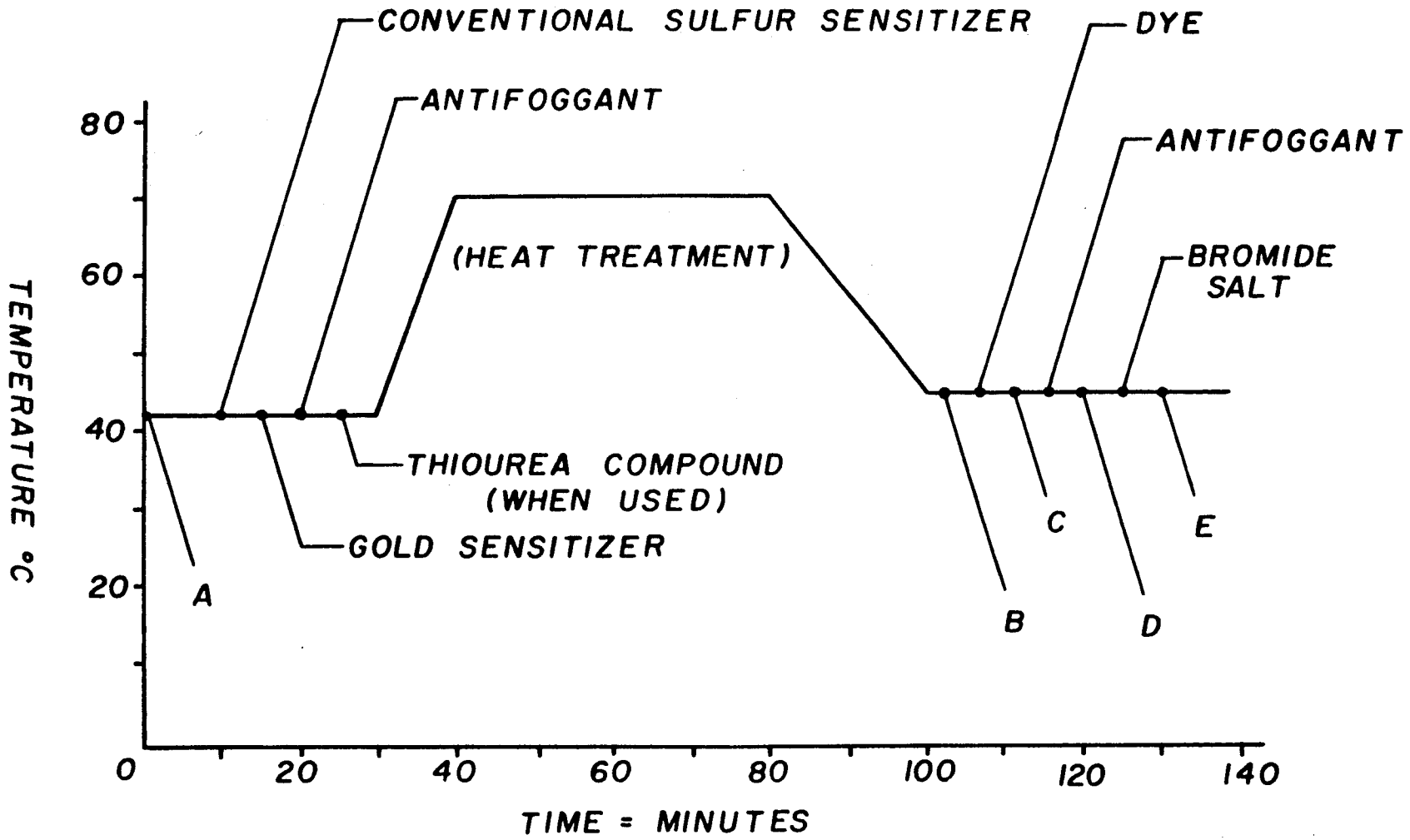
FIG. 1 illustrates a Sensitzation Profile in accordance with the invention.

The invention has numerous advantages over prior processes and products. While it has been found that the use of heavy metal salt during sensitization of high silver chloride emulsions gives improvements in both reciprocity behavior and latent image stability, it has also been found that there is a concommitant loss in photographic sensitivity and nondesirable increase in contrast. Surprisingly, it has been found that the organic sulfur sensitizer of the invention, in addition to the use of the conventional sulfur sensitizer, sodium thiosulfate, has been found to prevent the undesirable increase in contrast, while allowing the increase in sensitivity or speed of photographic materials formed utilizing the emulsion. Surprisingly, it has been found that iridium, when used in the sensitization process, may be added before or after the heat treatment, providing flexibility in the sensitization procedure. Further, the invention combination of the heavy metal salt and the thiourea has not been found to be deleterious to photographic properties of materials made using the chemically sensitized emulsion, while providing the increase in speed with good contrast. These and other advantages will be apparent from the detailed description below.

Illustrated in FIG. 1 is a preferred Sensitization Profile in accordance with the invention. Explanation of this temperature profile will aid in understanding the more detailed description which follows, particularly in terms of additions prior to and after the heat treatment. At the beginning of the process, there is provided a gelatin/water emulsion of silver halide grains (the substrate to be sensitized). This material is stirred at a beginning temperature of about 40° C. Then a conventional source of sulfur such as sodium thiosulfate is added with continued stirring followed by the source of gold. An antifoggant such as Compound I below then may be added followed by a substituted thiourea of the invention. It is noted that the potassium hexachloroiridate(IV) is added first (at A) in this preferred embodiment, although the iridium compound may be added either before (at A) or after (B, C, D, E) the heat treatment with little change in performance. After the sensitizing compounds have been added, a heat treatment is conducted to raise the emulsion to a temperature of about 70° C. where it is held for 20–60 minutes. It is then cooled to about 45° C. and held there with stirring and addition of a dye, an antifoggant such as Compound I, and a bromide salt such as potassium bromide.

The emulsion to be sensitized in the practice of this invention may be any silver halide or mixed halide, preferably a chlorobromide of greater than 90% chloride content and more preferably of greater than 98% chloride content. The high chloride emulsions are preferred because of their rapid developability and small environmental impact.

The emulsion may be of any morphology or grain size, preferably of cubic morphology and with cubic edge lengths in the range 0.1 to 2.0 micrometers, more preferably 0.2 to 1.2 micrometers. The most preferred edge size is 0.3 to 0.8 micrometers because these grain sizes provide the most appropriate levels of photographic sensitivity for photographic print materials.

A wide variety of conventional chemical and spectral sensitization schemes may be employed with the compounds of the invention. In the preferred embodiment of the invention, the chemical and spectral sensitizations are consecutive; the chemical sensitization is carried out by adding to the stirring emulsion an appropriate quantity of the conventional sulfur sensitizer sodium thiosulfate (also known as "hypo"), followed by an appropriate quantity of a soluble gold compound such as $KAuCl_4$ or $Na_3Au(S_2O_3)_2$, followed by an appropriate quantity of an organic antifoggant compound, such as Compound I.

A preferred scheme is illustrated in FIG. 1. In the preferred embodiment of the invention, the spectral sensitization consists of sequential addition of a spectral sensitizing dye, followed by an appropriate quantity of an organic antifoggant compound, followed by an appropriate quantity of a final salt solution, such as potassium bromide.

The dye utilized with the chemically sensitized invention materials can be any suitable spectral sensitizing dye, preferably one with the following general structure:

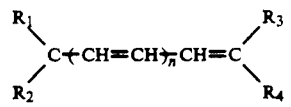

wherein $R_1$ through $R_4$ can be various organic or inorganic moieties, including cyclized groups. In the preferred embodiment of the invention, n=0 which means that the dye is not a carbocyanine dye as specifically required by the teaching of U.S. Pat. No. 4,693,965. The preferred spectral sensitizing dye has the structure shown below:

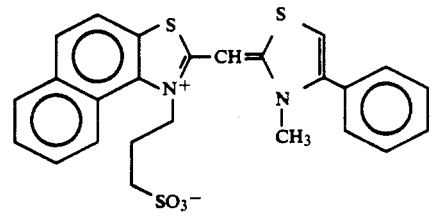

The organic antifoggant compounds that may be utilized with the invention materials can be any of a number of suitable such materials, preferably the following compound:

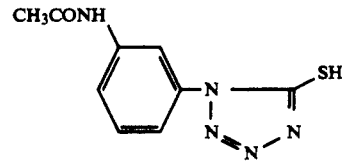

(Compound I)

The final salt solution added after sensitization may be a solution of any appropriate salt, preferably a solution of an alkali halide salt, more preferably a solution of an alkali bromide, such as potassium bromide. The quantity of this salt may be in the range 0.1 to 10 mole percent, preferably in the range 0.5 to 5 mole percent, more preferably in the range 1 to 2.5 mole percent.

The organic sulfur sensitizer is added after the conventional sulfur and gold sensitizers nd before the heat treatment, although it could be added at any time before the heat treatment.

The organic sulfur sensitizer suitable for use in the invention is of the general structural formula shown below:

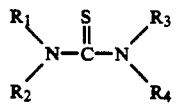

where $R_1$ through $R_4$ can be various organic or inorganic moieties, including cyclized groups. Compounds of this structure are substituted thioureas. In general, this type of sulfur sensitizer is used in conjunction with the more conventional sulfur sensitizer sodium thiosulfate.

Typical of substituted thioureas are those disclosed in U.S. Pat. No. 4,810,626 - Burgmaier et al at cols. 3 and 4.

Thioureas suitable for the invention include the following:

| | $R_1$ | $R_2$ | $R_3$ | $R_4$ |
|---|---|---|---|---|
| 1. | H | H | H | $C_6H_5$ |
| 2. | H | H | $C_6H_5$ | $C_6H_5$ |
| 3. | H | H | H | 4-$CH_3$—$C_6H_4$— |
| 4. | $CH_3$ | $CH_3$ | H | 4-$CH_3$—$C_6H_4$— |
| 5. | H | H | H | 4-Cl—$C_6H_4$— |
| 6. | H | H | H | 4-$CH_3O$—$C_6H_4$— |
| 7. | H | H | H | 3-$CH_3CONH$—$C_6H_4$— |
| 8. | H | H | H | $CH_3CO$— |
| and | | | | |
| 9. | 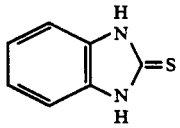 | | | |

In the preferred embodiment of the invention, $R_1=R_2=R_3=H$ and $R_4$ is the 3-acetamidophenyl moiety (Compound II and No. 7 in the list above).

The quantity of said thiourea compound to be used in the practice of this invention may vary over the range $1\times10^{-9}$ to $1\times10^{-3}$ mole of thiourea per mole of silver halide, but is preferably in the range $1\times10^{-7}$ to $5\times10^{-5}$ mole per mole of silver halide.

The heavy metal compound suitable for the invention is of the general formula $$R_aM_bX_c\cdot d\ H_2O$$

where the R constituents are generally alkali metal cations, preferably Na or K, most preferably K; M may be any metal, preferably from Group VIII of the Periodic Table, such as osmium, ruthenium, iridium, platinum, palladium, and rhodium. Most preferred is the element of atomic number 77, namely iridium; the X groups are generally halide ligands, preferably Cl or Br, most preferably Cl. The salt may be a hydrated salt. Generally a=1 to 4, b=1 to 2, c=3 to 6, and d=0 to 2. Typical of Iridium compounds suitable for the invention are those of Col. 3 in U.S. Pat. No. 4,997,751 - Kim.

The quantity of said heavy metal compound to be used in the practice of this invention may vary over the range $1\times10^{-10}$ to $1\times10^{-4}$ mole of heavy metal compound per mole of silver halide, but is preferably in the range $1\times10^{-8}$ to $5\times10^{-6}$ mole per mole of silver halide.

We have achieved successful use of the Ir(IV) compound $K_2IrCl_6$ either: A) before the conventional sulfur sensitizer; B) between the heat treatment and the dye; C) between the dye and the antifoggant; D) between the antifoggant and the final salt solution (KBr); and e) shortly after the KBr addition. Indeed, the Ir compound can be added at any time before or during the metathesis (synonyms: transhalogenation, halide conversion, or halide exchange) which occurs as a consequence of NaBr or KBr addition to a high-chloride emulsion. The use of Ir improves reciprocity.

Whereas the preferred solutions are of $K_2IrCl_6$ (stabilized with nitric acid, $HNO_3$), following the teaching of U.S. Pat. No. 4,902,611, the Ir salt could in another embodiment be added with a Lippmann AgBr emulsion or in a common solution with the KBr. The Ir salt could be an iridium complex with bromide, e.g., $K_2IrBr_6$, instead of the chloride complex ion. The bromide source could be a soluble salt like KBr or NaBr, a silver bromide emulsion, such as the Lippmann AgBr mentioned above, or a hydrolyzable organobromine compound.

The following examples illustrate the practice of this invention. They are not intended to be exhaustive of all possible variations of the invention. Parts and percentages are by weight unless otherwise indicated.

General Sensitization and Test Procedures

A quantity of from 0.1 to 10 moles of a pure AgCl substrate of cubic edge length from 0.3 to 0.8 micrometers, which had been precipitated in gelatin from the double-jet reaction of silver nitrate and sodium chloride, is taken and heated to about 40° C. This emulsion is given an optimal chemical sensitization by treating it with about $2\times10^{-6}$ mole of sodium thiosulfate pentahydrate per mole of silver chloride, followed by about an equal molar amount of trisodium aurous dithiosulfate, followed by about $1\times10^{-4}$ mole of Compound I, followed by the appropriate quantity of a thiourea compound (when used), followed by a heat treatment consisting of slowly increasing the temperature of the mixture to about 70° C., holding at that temperature for 20 to 60 minutes, and then cooling again to about 45° C.

The above emulsion is then spectrally sensitized and prepared for use in a photographic element by adding about $3\times10^{-4}$ mole of dye per mole of silver chloride, followed by about an equal molar amount of Compound I, followed by from 0.1 to 10.0 mole percent of potassium (or sodium) bromide, followed by cooling the mixture to a temperature between 0° and 5° C.

Portions of emulsions sensitized as described above were coated on transparent film support, along with additional gelatin, a color-forming organic coupling compound or compounds, appropriate surfactants, and a hardening agent for the gelatin. Such photographic elements were then dried and exposed for 1/500" by means of a 3000° K. tungsten light source through a tablet consisting of steps with 0.15 optical density increments, in order to provide 0.15 incremental log(exposure) latent images in the photographic element.

The thus exposed photographic elements were then developed for times ranging from 1-5 minutes (usually 3 minutes) at about 35° C. in a solution consisting of one of the standard color developing agents, well known in photographic laboratories, followed by an appropriate acidic solution to terminate the development reaction, then followed by one of the standard bleach solutions, then followed by a fixer solution containing sodium thiosulfate ("hypo").

The thus developed, bleached and fixed photographic elements were again dried and the optical densities due to dye formation, if any, were measured in one of the many densitometers well known in photographic laboratories, using filters in the densitometer appropriate to the intended use of the photographic element.

Dye density was then graphed vs. log(exposure) to form the so-called characteristic curve of the photographic element. The relative photographic sensitivity at the pre-determined density of 1.0 was measured, with the relative photographic sensitivity measured from the end of the log(exposure) scale which represents the greatest exposure to the photographic element. When the characteristic curve passes through a density=1.0 farther from the end of the log(exposure) scale which represents the greatest exposure, then that photographic element is considered to be faster in speed or higher in relative photographic sensitivity.

EXAMPLES 1-8

Taking a pure silver chloride substrate of 0.6-micrometer edge length, 0.1-mole sensitizations, both chemical and spectral, were carried out with several combinations of $K_2IrCl_6$+KBr before the conventional sulfur sensitizer and the gold sensitizer were added. The Ir compound was added first, followed within about one minute by the KBr, after which the mixture was stirred at 43° C. for 10 minutes before the chemical sensitizers were added. The chemical ripening hold time at 71° C. was 25 minutes. No thiourea compound was used in these examples. Table 1 below shows the effects of the Ir compound on $D_{min}$ and relative sensitivity:

TABLE 1

| Example | mg/mole $K_2IrCl_6$ | mg/mole KBr | $D_{min}$ | Relative Sensitivity |
|---|---|---|---|---|
| 1 (control) | 0.000 | 0 | 0.073 | 100 |
| 2 (control) | 0.000 | 100 | 0.083 | 101 |
| 3 (control) | 0.050 | 0 | 0.072 | 90 |
| 4 (control) | 0.050 | 100 | 0.095 | 77 |
| 5 (control) | 0.025 | 50 | 0.079 | 95 |
| 6 (control) | 0.025 | 150 | 0.073 | 89 |
| 7 (control) | 0.075 | 50 | 0.082 | 77 |
| 8 (control) | 0.075 | 150 | 0.077 | 72 |

Example 2 shows that adding bromide alone has no effect on photographic sensitivity, but all of the examples containing iridium show reduced sensitivity.

EXAMPLES 9-12

These examples illustrate the surprising sensitivity increase associated with the use of both Ir and thiourea compounds.

Four 40-minute sensitizations, each 2.5 moles, were made as in Examples 1-8 with variations and results shown in Table 2 below. In these examples no KBr was added before the chemical sensitizers (sulfur, gold, etc.) The Ir compound was added 10 minutes prior to the conventional sulfur sensitizer. The thiourea Compound II was added just before the heat treatment. Approximately 1.5 mole percent KBr was added after the spectral sensitization as in Examples 1-8 (see FIG. 1).

TABLE 2

| Example | mg/mole $K_2IrCl_6$ | mg/mole Thiourea* | $D_{min}$ | Relative Sensitivity |
|---|---|---|---|---|
| 9 (control) | 0.00 | 0.00 | 0.062 | 100 |
| 10 (control) | 0.00 | 0.61 | 0.120 | 93 |
| 11 (control) | 0.05 | 0.00 | 0.057 | 77 |
| 12 (invention) | 0.05 | 0.61 | 0.125 | 123 |

*Compound II

These examples clearly show that either the iridium compound or the thiourea alone decrease sensitivity, but that the combination of the two increases sensitivity.

EXAMPLES 13-22

Small (0.1-mole) portions of an emulsion were sensitized by first adding the $K_2IrCl_6$ solution, waiting for the times indicated, then continuing with the chemical sensitization as in Examples 1-8. The thiourea was added as in Examples 10 and 12. The chemical sensitization contained the thiourea levels given below in Table 3, and the chemical ripening time was 35 minutes.

TABLE 3

| Example | Ir Level | Time | Thiourea* | Relative Sensitivity |
|---|---|---|---|---|
| 13 (control) | 0.025 | 2' | 0.00 | 100 |
| 14 (control) | 0.025 | 10' | 0.00 | 101 |
| 15 (invention) | 0.025 | 0 | 0.61 | 112 |
| 16 (invention) | 0.025 | 2' | 0.61 | 117 |
| 17 (invention) | 0.025 | 5' | 0.61 | 111 |
| 18 (invention) | 0.025 | 10' | 0.61 | 110 |
| 19 (invention) | 0.050 | 0 | 0.61 | 126 |
| 20 (invention) | 0.050 | 2' | 0.61 | 119 |
| 21 (invention) | 0.050 | 5' | 0.61 | 120 |
| 22 (invention) | 0.050 | 10' | 0.61 | 120 |

*Compound II

These examples show that a sensitivity increase is realized when both the iridium and the thiourea compound are present and that the effect is dependent on the iridium level used.

EXAMPLE 23-26

For these examples, essentially the same procedure was followed as for Examples 13-22 except that the iridium compound was added after the 28-minute heat treatment, between the dye and the antifoggant, whereas the substituted thiourea Compound II was still added before the heat treatment.

TABLE 4

| Example | Thiourea* | Ir | Relative Sensitivity |
|---|---|---|---|
| 23 (control) | 0.00 | 0.00 | 100 |
| 24 (control) | 0.00 | 0.10 | 89 |
| 25 (control) | 0.61 | 0.00 | 95 |
| 26 (invention) | 0.61 | 0.10 | 120 |

*Compound II

These examples show that the same sensitivity increase occurs when the IR compound is added after the chemical and spectral sensitization, but before the final KBr is added. It is, therefore, clear in Table 4 that the presence of iridium in these sensitizations caused a speed loss but that when the thiourea compound was used in addition to the iridium, there was a speed increase.

The invention has been described in detail with particular reference to preferred embodiments thereof, but it will be understood that variations and modifications can be effected within the spirit and scope of the invention.

We claim:

1. A silver halide photographic emulsion comprising silver chloride grains that have been surface sensitized with a heavy metal compound comprising $R_aM_bX_c \cdot d\ H_2O$ wherein R=an alkali metal cation M=Ir X=a halide ligand a=1 to 4 b=1 to 2 c=5 or 6 d=0 to 2, and a thiourea compound comprising at least one of

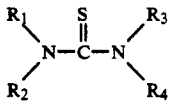

| | $R_1$ | $R_2$ | $R_3$ | $R_4$ |
|---|---|---|---|---|
| 1. | H | H | H | $C_6H_5$ |
| 2. | H | H | $C_6H_5$ | $C_6H_5$ |
| 3. | H | H | H | $4\text{-}CH_3\text{—}C_6H_4\text{—}$ |
| 4. | $CH_3$ | $CH_3$ | H | $4\text{-}CH_3\text{—}C_6H_4\text{—}$ |
| 5. | H | H | H | $4\text{-}Cl\text{—}C_6H_4\text{—}$ |
| 6. | H | H | H | $4\text{-}CH_3O\text{—}C_6H_4\text{—}$ |
| 7. | H | H | H | $3\text{-}CH_3CONH\text{—}C_6H_4\text{—}$ |
| 8. | H | H | H | $CH_3CO\text{—}$ |

and

9.

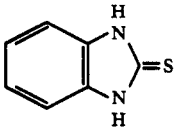

and wherein said emulsion is also surface sensitized with sodium thiosulfate pentahydrate.

2. The emulsion of claim 1 wherein R is potassium, a=2, M is iridium, b=1, X is chloride, c=6, and d=0.

3. The emulsion of claim 1 wherein said heavy metal compound comprises $K_2IrCl_6$.

4. The emulsion of claim 1 wherein said emulsion further has been surface sensitized with a gold sensitizer.

5. The emulsion of claim 1 wherein said grains further have bromide deposited on their surface.

6. The emulsion of claim 1 wherein $R_1=R_2=R_3=H$ and $R_4$ is a 3 acetamidophenyl moiety.

7. A method of sensitizing a silver halide emulsion comprising providing an emulsion comprising silver chloride grains, adding a thiourea compound comprising at least one of

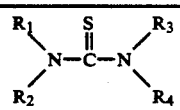

| | $R_1$ | $R_2$ | $R_3$ | $R_4$ |
|---|---|---|---|---|
| 1. | H | H | H | $C_6H_5$ |
| 2. | H | H | $C_6H_5$ | $C_6H_5$ |
| 3. | H | H | H | $4\text{-}CH_3\text{—}C_6H_4\text{—}$ |

-continued

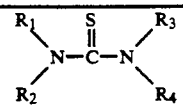

| | $R_1$ | $R_2$ | $R_3$ | $R_4$ |
|---|---|---|---|---|
| 4. | $CH_3$ | $CH_3$ | H | $4\text{-}CH_3\text{—}C_6H_4\text{—}$ |
| 5. | H | H | H | $4\text{-}Cl\text{—}C_6H_4\text{—}$ |
| 6. | H | H | H | $4\text{-}CH_3O\text{—}C_6H_4\text{—}$ |
| 7. | H | H | H | $3\text{-}CH_3CONH\text{—}C_6H_4\text{—}$ |
| 8. | H | H | H | $CH_3CO\text{—}$ |

and

9.

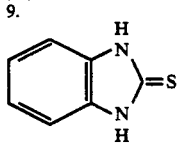

to said emulsion, and heating said emulsion to complete chemical sensitization, with the proviso that a heavy metal compound, comprising $R_aM_bX_c \cdot d\ H_2O$ wherein R=an alkali metal cation M=iridium X=a halide ligand a=1 to 4 b=1 to 2 c=5 or 6 d=0 to 2, is added to said emulsion prior to heating, or after said emulsion has been cooled after said heating, and wherein said emulsion is also surface sensitized with sodium thiosulfate pentahydrate.

8. The method of claim 7 wherein said heavy metal compound is added prior to addition of a potassium bromide at the end of sensitization.

9. The method of claim 7 wherein prior to said heating gold sensitizer is added to said emulsion.

10. The method of claim 7 wherein prior to said heating, an organic antifoggant is added to said emulsion.

11. The method of claim 10 wherein said organic antifoggant comprises

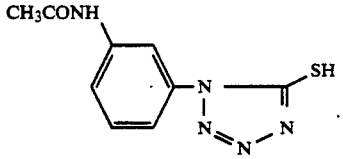

12. The method of claim 7 wherein said thiourea comprises

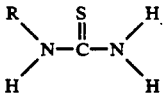

wherein R equals 3-acetamidopheyl.

13. The method of claim 12 wherein said heavy metal compound comprises $K_2IrCl_6$.

14. The method of claim 7 wherein R is potassium, a=2, M is iridium, b=1, X is chloride, c=6, and d=0.

15. The method of claim 7 wherein gold, and an organic antifoggant are added prior to heating.

16. The method of claim 7 wherein there is no bromide present during heating said emulsion to complete chemical sensitization.

* * * * *

UNITED STATES PATENT AND TRADEMARK OFFICE

CERTIFICATE OF CORRECTION

PATENT NO. : 5,283,168

DATED : February 1, 1994

INVENTOR(S) : Roger W. Nelson et al

It is certified that error appears in the above-indentified patent and that said Letters Patent is hereby corrected as shown below:

Column 10, lines 2-5, remove

" _____

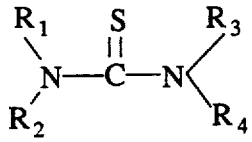

" .

Column 10, line 39, before "gold" insert --,--.

Column 10, line 59, "3-acetamidopheyl" should read --3-acetamidophenyl--.

Signed and Sealed this

Thirteenth Day of September, 1994

*Attest:*

*Attesting Officer*

BRUCE LEHMAN

*Commissioner of Patents and Trademarks*